US009046819B2

(12) United States Patent
Furuki et al.

(10) Patent No.: US 9,046,819 B2
(45) Date of Patent: Jun. 2, 2015

(54) TONER TRANSPORT DEVICE, AND IMAGE FORMING APPARATUS

(71) Applicant: FUJI XEROX CO., LTD., Tokyo (JP)

(72) Inventors: Manabu Furuki, Kanagawa (JP); Masashi Ikeda, Kanagawa (JP); Tatsuhiro Igarashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/971,230

(22) Filed: Aug. 20, 2013

(65) Prior Publication Data

US 2014/0212178 A1 Jul. 31, 2014

(30) Foreign Application Priority Data

Jan. 31, 2013 (JP) ..... 2013-016422

(51) Int. Cl.
*G03G 15/08* (2006.01)

(52) U.S. Cl.
CPC ..... *G03G 15/0879* (2013.01); *G03G 15/0891* (2013.01); *G03G 2215/0802* (2013.01)

(58) Field of Classification Search
CPC ..... G03G 15/0891; G03G 15/0893; G03G 15/0887; G03G 15/0877; G03G 15/0865
USPC ..... 399/254
See application file for complete search history.

(56) References Cited

U.S. PATENT DOCUMENTS

| | | | | |
|---|---|---|---|---|
| 6,122,472 | A * | 9/2000 | Sako et al. | 399/254 |
| 8,571,446 | B2 * | 10/2013 | Iwata | 399/256 |
| 8,718,496 | B2 * | 5/2014 | Barry et al. | 399/27 |
| 2011/0123230 | A1 * | 5/2011 | Suenami et al. | 399/254 |
| 2011/0170911 | A1 * | 7/2011 | Yoshimoto et al. | 399/256 |
| 2012/0269555 | A1 * | 10/2012 | Matsumoto et al. | 399/258 |
| 2013/0156468 | A1 * | 6/2013 | Hayashi et al. | 399/254 |

FOREIGN PATENT DOCUMENTS

| | | |
|---|---|---|
| JP | A-2002-148916 | 5/2002 |
| JP | A-2006-171105 | 6/2006 |
| JP | A-2008-129210 | 6/2008 |

* cited by examiner

*Primary Examiner* — Clayton E Laballe
*Assistant Examiner* — Leon W Rhodes, Jr.
(74) *Attorney, Agent, or Firm* — Oliff PLC

(57) ABSTRACT

Provided is a toner transport device including a transport member that transports a developer in one direction, a toner feeding member disposed adjacent to, in a direction crossing the one direction, an end portion of the transport member, and a housing that is provided with a toner receiving port which receives supply of toner in an upper section of the toner feeding member, and accommodates the transport member and the toner feeding member, wherein the toner feeding member includes a rotating shaft, and a flat plate portion that protrudes in a direction away from a shaft member with one side thereof being connected to the shaft member and a front end portion away from the shaft member having a tapered shape, the flat plate portion rotating along with rotation of the shaft member to scrape the toner that moves from the toner receiving port toward the toner feeding member.

12 Claims, 5 Drawing Sheets

TONER TRANSPORT DEVICE, AND IMAGE FORMING APPARATUS

CROSS-REFERENCE TO RELATED APPLICATIONS

This application is based on and claims priority under 35 USC 119 from Japanese Patent Application No. 2013-016422 filed on Jan. 31, 2013.

BACKGROUND (i) Technical Field

The present invention relates to a toner transport device, and an image forming apparatus.

(ii) Related Art

Nowadays, the diameter of toner particles generally tends to decrease for improving image quality.

SUMMARY

According to an aspect of the present invention, there is provided a toner transport device including: a transport member that transports a developer in one direction; a toner feeding member that is disposed adjacent to, in a direction crossing the one direction, an end portion of the transport member; and a housing that is provided with a toner receiving port which receives supply of toner in an upper section of the toner feeding member, and accommodates the transport member and the toner feeding member, wherein the toner feeding member includes: a rotating shaft; and a flat plate portion that protrudes in a direction away from a shaft member with one side thereof being connected to the shaft member and a front end portion which is away from the shaft member having a tapered shape, the flat plate portion rotating along with rotation of the shaft member to scrape the toner that moves from the toner receiving port toward the toner feeding member.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the present invention will be described referring to the accompanying drawings.

(First Exemplary Embodiment)

Figure 1:
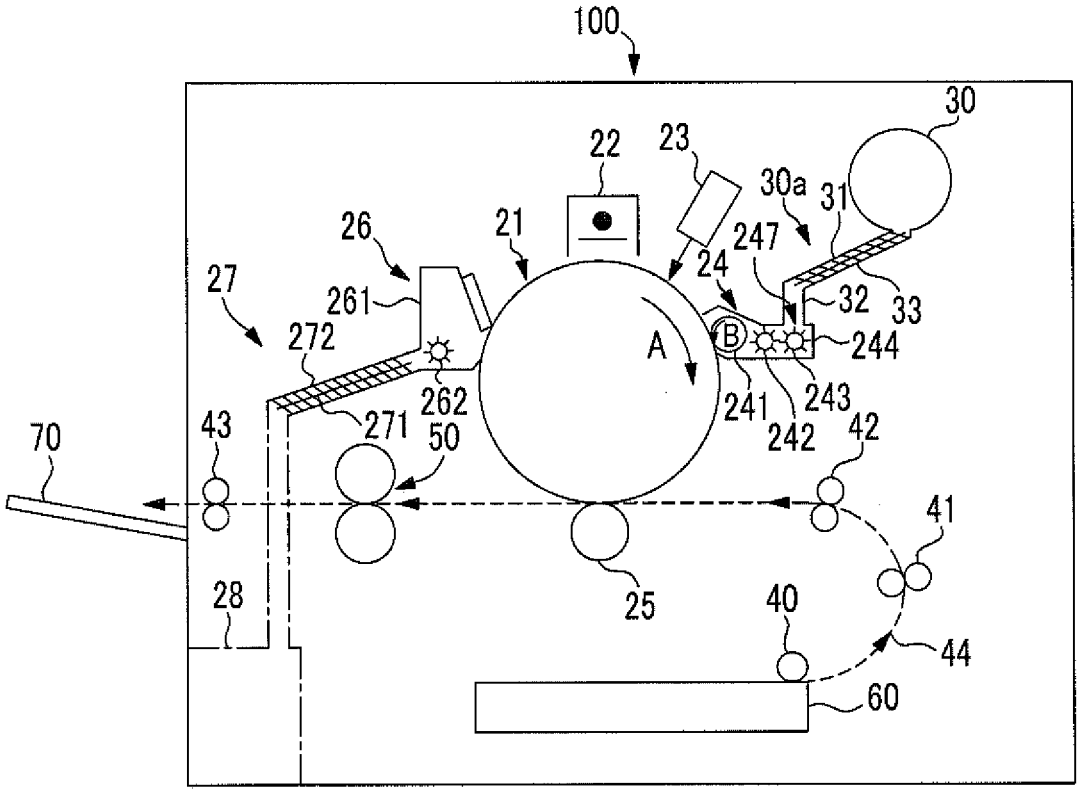
FIG. 1 is an overall block diagram showing an image forming apparatus according to a first embodiment.

FIG. 1 is an overall configuration diagram showing an image forming apparatus 100 according to a first exemplary embodiment.

The image forming apparatus 100 includes a cylindrical photoreceptor 21 that rotates in a direction of arrow A. A charging unit 22, an exposure unit 23, a developing unit 24, a transfer unit 25, and a cleaning unit 26 are provided around the photoreceptor 21.

The charging unit 22 charges a surface of the photoreceptor 21 to a predetermined potential.

The exposure unit 23 emits exposure light to the surface of the photoreceptor 21 that is modulated based on an image signal, and forms an electrostatic latent image of charging potential distribution on the surface of the photoreceptor 21.

A developer including toner and a carrier is accommodated in the developing unit 24. The developing unit 24 develops the electrostatic latent image on the photoreceptor 21 using the toner in the developer so as to form a toner image on the surface of the photoreceptor.

The transfer unit 25 transfers the toner image on the photoreceptor 21 onto sheets that are transported in such a manner as described below.

The image forming apparatus 100 includes a sheet tray 60 that accommodates stacked sheets. Of the stacked sheets inside the sheet tray 60, the uppermost one sheet is taken out by a pick-up roller 40. The sheet that is taken out is transported by a feed roller 41, and the transporting of the sheet stops at a moment when a lead edge of the sheet reaches a registration roller 42 so that the sheet stands by in this state. The sheet in the standby state is fed from the registration roller 42 after timing adjustment so that the sheet goes to a position of the transfer unit 25 at a moment when the toner image on the photoreceptor 21 reaches the transfer unit 25, and the toner image on the photoreceptor is transferred onto the sheet by operation of the transfer unit 25. A fuser 50 is provided on a further downstream side of a sheet transport path. The fuser 50 heats and pressurizes the toner image on the transported sheet so as to fuse the toner image onto the sheet. The sheet, on which an image having the fused toner image is formed by going through the fuser 50, is fed onto a discharge tray 70 by a discharge roller 43. In FIG. 1, a sheet path 44 along which the sheet is taken out from the sheet tray 60 and is fed onto the discharge tray 70 is indicated by a dotted arrow.

Also, residual toner on the photoreceptor 21, which remains after the transfer of the toner image, is removed from the photoreceptor 21 by the cleaning unit 26.

Herein, two transport members 242 and 243 that extend in parallel with each other in a direction which is perpendicular to a page face in FIG. 1, and a developing roller 241 are provided inside a case 244 of the developing unit 24. The two transport members 242 and 243 are members that rotate to stir the developer while circulating and moving the developer inside the case 244.

Also, the developing roller 241 rotates in a direction of arrow B so as to transport the developer inside the case 244 to an area facing the photoreceptor 21. The electrostatic latent image on the photoreceptor 21 is developed by the toner in the developer that is transported by the developing roller 241. Therefore, if the development is repeated, the toner in the developer inside the case 244 runs low. As such, the image forming apparatus 100 is provided with a detachable toner cartridge 30 that accommodates toner. When the amount of the toner in the developing unit 24 decreases, the toner accommodated in the toner cartridge 30 is supplied to the developing unit 24 through a toner supply passage 30*a* by the same amount as the decreased amount. Herein, the toner supply passage 30*a* includes a first supply passage 31 that transports the toner supplied from the toner cartridge 30, and a second supply passage 32 that drops the toner which is transported through the first supply passage 31 into the case 244 of the developing unit 24. A transport member 33 that extends in a direction in which the first supply passage 31 extends and rotates to transport the toner is provided inside the first supply passage 31. The number of rotation of the transport member 33 corresponds to the decreased amount of the toner inside the developing unit 24, and thus the developing unit 24 is supplemented with the same amount of the toner as the decreased amount of the toner inside the developing unit 24. The second supply passage 32 includes no transport member. The second supply passage 32 is configured in such a manner that the toner is supplied to the developing unit 24 through free fall from a toner receiving port 247 that is formed on an upper surface of the case 244.

Also, the toner that remains in the photoreceptor 21 is accommodated in a case 261 of the cleaning unit 26. By a transport member 262 that is provided inside the case 261 and extends in the direction perpendicular to the page space in FIG. 1, the toner inside the case 261 is transported to a corner in the same direction, and is accommodated in a waste toner tank 28 after going through a toner discharge passage 27. The toner discharge passage 27 includes a first discharge passage 272 that transports the toner which is transported to the above-described corner by the transport member 262, and a second discharge passage 273 that drops the toner which is transported through the first discharge passage 272 into the waste toner tank 28. A transport member 271 that extends in a direction in which the first discharge passage 272 extends and rotates to transport the toner is provided inside the first discharge passage 272. The toner that is transported by the transport member 271 is dropped into the second discharge passage 273, and is accommodated in the waste toner tank 28.

Figure 2:
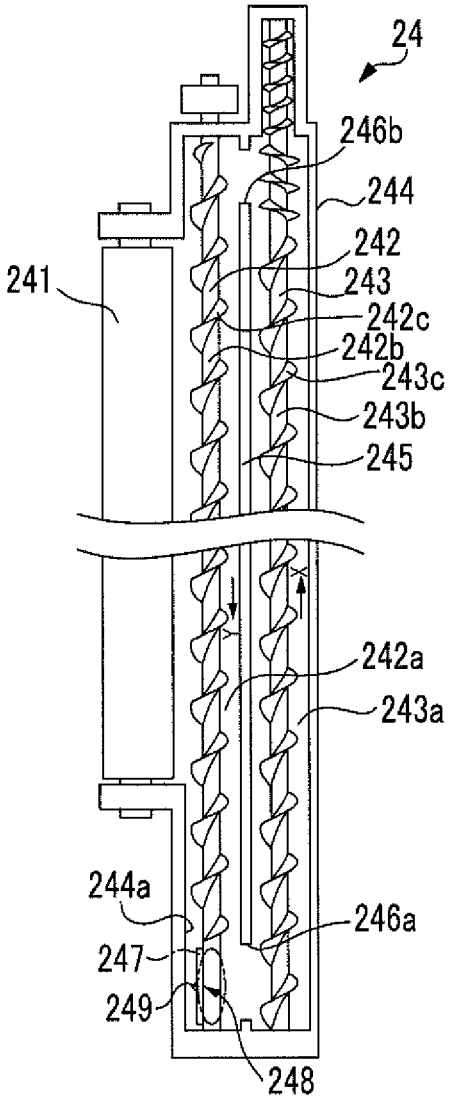
FIG. 2 is a perspective view showing an inner side of a developing unit that is outlined in FIG. 1, when viewed from above.

FIG. 2 is a perspective view showing an inner side of the developing unit 24 that is outlined in FIG. 1, when viewed from above.

As described referring to FIG. 1, the developing unit 24 includes the two transport members 242 and 243 that extend in parallel with each other, and the developing roller 241 that rotates in the direction of arrow B as shown in FIG. 1.

Inside the case 244, a partition wall 245 is provided between the two transport members 242 and 243. The case 244 is partitioned into two chambers 242*a* and 243*a*. Openings 246*a* and 246*b* are respectively formed in both end portions in a longitudinal direction of the partition wall 245.

The two transport members 242 and 243 respectively include round bar-shaped rotating shafts 242*b* and 243*b*, and spiral blades 242*c* and 243*c* that are provided around the rotating shafts and extend in a spiral form in a direction in which the rotating shafts 242*b* and 243*b* extend. The transport member 243 rotates so as to transport the toner inside the case 244 in a direction of arrow X, and the transport member 242 rotates so as to transport the toner into a direction of arrow Y. In an upper surface portion corresponding to an end portion of the transport member 242 of the case 244, the toner receiving port 247 is provided to receive the toner that is supplied through the first supply passage 31 from the toner cartridge 30 (refer to FIG. 1). In the end portion of the transport member 242, a flat plate member 248 whose one side is connected to the rotating shaft 242*b* is provided in such a manner as to spread in a direction away from the rotating shaft 242*b*. As will be described later, the toner that drops from the toner receiving port 247 toward the end portion of the transport member 242 is fed to the transport member 243 as the flat plate member 248 rotates along with rotation of the transport member 242. In this manner, new toner that is supplied from the toner receiving port 247 is sent to the transport member 243.

The new toner that is sent to the transport member 243 is transported in the direction of arrow X inside the chamber 243*a* in which the transport member 243 is disposed. During the transporting, the new toner is agitated and mixed with the developer inside the chamber 243*a*. The developer that is agitated and mixed with the new toner is moved through the opening 246*b* to the chamber 242*a* in which the transport member 242 is disposed, and then is transported in the direction of arrow Y by the transport member 242 inside the chamber 242*a*. In this manner, the new toner is moved to the chamber 243*a* through the opening 246*a*.

The developer inside the developing unit 24 is circulated and moved in such a manner as described above, and agitated and mixed with the new toner.

The developing roller 241 receives the developer from the chamber 242*a* in which the transport member 242 is disposed, and carries the developer to the area facing the photoreceptor 21 shown in FIG. 1 so that the developer whose carrier ratio is increased as the toner is reduced by the development is returned into the case 244. The developer whose carrier ratio is increased is transported and agitated as described above to be mixed with the new toner, and is circulated as the developer that has the toner of the original ratio and the carrier.

Next, the feeding of the new toner to the transport member 243 by the flat plate member 248 will be described.

Figure 3:
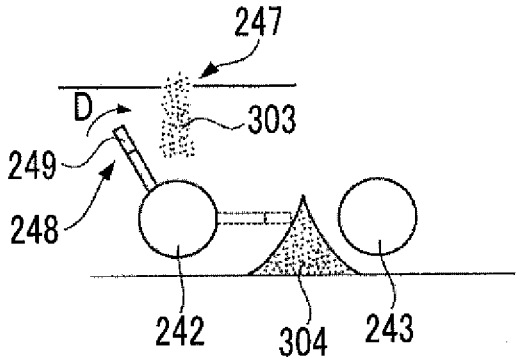
FIG. 3 is a view showing how new toner is fed by a flat plate member to a transport member.

FIG. 3 is a view showing how the new toner is fed by the flat plate member 248 to the transport member 243.

In FIG. 3, the end portion of the transport member 242 in the vicinity of the toner receiving port 247 in FIG. 2 is viewed from a left side of FIG. 2. A feeding mechanism for the new toner that is shown in FIG. 3, which uses the flat plate member 248, is a toner transport device according to the first embodiment of the present invention.

When the toner is agitated and transported as shown in FIG. 2, the transport member 242 that includes the flat plate member 248 rotates in a direction of arrow D shown in FIG. 3. Along with the rotation, the flat plate member 248 that is provided in the end portion of the transport member 242 rotates in the direction of arrow D, too. As described above, the new toner is dropped from the toner receiving port 247 above the end portion of the transport member 242. The new toner that is dropped is fed toward the transport member 243 by the flat plate member 248 that rotates in the direction of arrow D.

In the related art, there are developing devices in which a flat plate member attached to an end portion of a transport member feeds toner supplied from a toner receiving port toward another transport member other than the transport member. In general, a rectangular-shaped flat plate member that extends in a direction of a rotating shaft of the transport member and in a direction away from the rotating shaft is used as the flat plate member.

In a case where the feeding of the toner toward the above-described another transport member on an upstream side of the direction in which a developer is transported is repeated by the rectangular-shaped flat plate member, there is a case where a toner wall is formed between the end portion of the transport member to which the flat plate member is attached and the another transport member to which the toner is fed. When the toner wall grows to be large in size, the toner that is dropped from the toner receiving port and fed by the flat plate member is blocked by the toner wall, does not reach the another transport member, and is deposited in the vicinity of the end portion to which the flat plate member is attached to cause clogging of the toner. When the clogging of the toner occurs, there is a problem that the toner which is necessary for the development of an electrostatic latent image runs low, and there is a further problem that the rotation of the transport member is inhibited.

In the field of image forming apparatuses of recent years, the diameter of toner has a decreasing tendency as image resolution improves. In such small-diameter toner, friction per unit volume between toner particles is high, and the fluidity of the toner is low, and thus the toner wall that is described above is likely to be formed. Therefore, the clogging of the toner is likely to occur in the small-diameter toner.

Herein, three experiments showing a relationship between a volume average particle diameter of the toner and fluidity of the toner will be described.

FIRST EXPERIMENT

In the First Experiment, the relationship between the volume average particle diameter of the toner and the fluidity of the toner is investigated by measuring a transport speed of the toner.

In the First Experiment, a transport member is disposed inside a cylindrical pipe, the transport member is rotated to transport the toner into the pipe, and the transport speed of the toner (g per second) is measured. Herein, the inner diameter of the cylindrical pipe is 15 mm. Also, the transport member has a shaft diameter of 2.6 mm, the pitch of plural spiral-shaped blades thereof is 18.5 mm, and the width of the spiral-shaped blade with regard to a direction that is perpendicular to an axial direction (what is evaluated by converting a distance between one end portion of the axial spiral-shaped blade and an end portion on an opposite side to the end portion into a distance with regard to the direction that is perpendicular to the axial direction) is 10 mm. Also, the transport member has a rotational speed of 67 revolutions per minute.

As a result of performing the measurement of the transport speed of the toner with regard to the toner with a volume average particle diameter of 5.8 μm to which an external additive of 6.2 wt % is added, the transport speed of the toner turns out to be 0.23 g per second. Herein, the toner with the volume average particle diameter of 5.8 μm has been in wide use in image forming apparatuses in the related art since before the small-diameter began to be noted.

Also, as a result of performing the measurement of the transport speed of the toner with regard to the toner with a volume average particle diameter of 4.5 μm to which the same external additive of 6.2 wt % is added, the transport speed of the toner turns out to be 0.13 g per second.

From the results of the two experiments for measuring the transport speed of the toner, it is known that the transport speed of the toner decreases, that is, the fluidity of the toner decreases as the volume average particle diameter of the toner decreases. In particular, in the case where the toner with the volume average particle diameter of 4.5 μm is used, the transport speed of the toner decreases to an approximately 57% level (≅0.13/0.23) when compared to the case where the toner with the volume average particle diameter of 5.8 μm is used. In a case where the small-diameter toner with a volume average particle diameter of 4.5 μm or less is used, the transport speed of the toner is estimated to be about 57% of less (when compared to the case where the toner with the volume average particle diameter of 5.8 μm is used). Therefore, when the toner with the volume average particle diameter of 4.5 μm or less is used, there is a particular concern that the clogging of the toner occurs due to the decrease in the fluidity.

Furthermore, the transport speed of the toner is changed by not only the volume average particle diameter of the toner but also the weight percent of the external additive. For example, as a result of performing the above-described experiment in a case where the external additive of 6.6 wt % is added to the toner with the volume average particle diameter of 4.5 μm, the transport speed of the toner turns out to be 0.18 g per second. When the external additive of 6.6 wt % is added, the transport speed of the toner is higher than in a case where the external additive of 6.2 wt % is added to the same toner with the volume average particle diameter of 4.5 μm. This is because the amount of the toner with the volume average particle diameter of 4.5 μm is relatively smaller in the former case than in the latter case. However, from the perspective of securing the amount of the toner that is necessary for resolution improvement, it is difficult to prevent the clogging of the toner caused by the decrease in the fluidity by increasing the amount of the external additive (decreasing the amount of the toner particles), and thus another measure is necessary.

SECOND EXPERIMENT

In the Second Experiment, the relationship between the volume average particle diameter of the toner and the fluidity of the toner is investigated by measuring an angle of repose (whose definition will be described later) of the toner.

Figure 4:
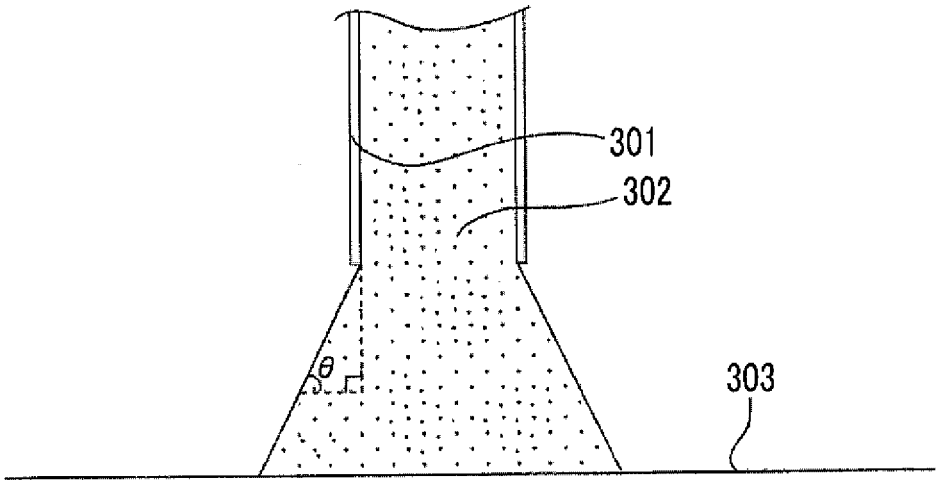
FIG. 4 is an explanatory diagram showing a method for measuring an angle of repose.

FIG. 4 is an explanatory diagram showing a method for measuring the angle of repose.

In the Second Experiment, toner 303 is dropped onto a flat plate 302 from a cylinder 301. At this time, the toner has a mountain-like shape on the flat plate 302, and the tilt θ [°] of the mountain-like shape is the angle of repose. The angle of repose is measured with regard to the toner with the various volume average particle diameters [μm].

In general, the angle of repose θ is small for the high-fluidity toner, and the angle of repose θ is large for the low-fluidity toner. In the Second Experiment, it is possible to investigate the degree of the fluidity of the toner with the various volume average particle diameters [μm] by measuring the angle of repose.

Figure 5:
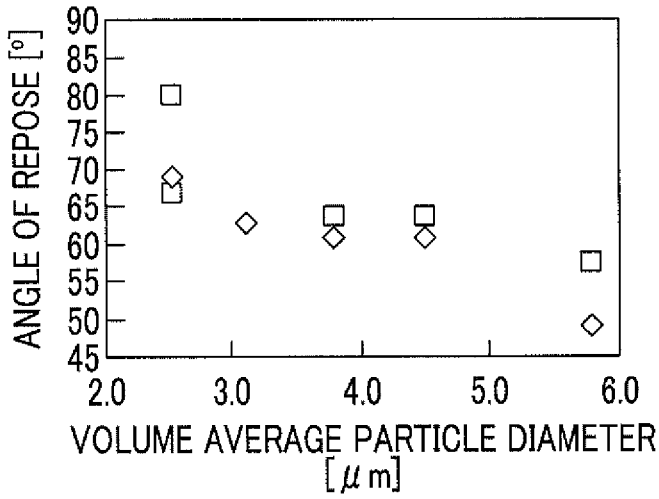
FIG. 5 is a view showing a result of measurement of the angle of repose [°] with respect to a volume average particle diameter [μm] of the toner.

FIG. 5 is a view showing a result of measurement of the angle of repose [°] with respect to the volume average particle diameter [μm] of the toner. The difference in symbols in the same volume average particle diameter represents the toner of different types that have the same volume average particle diameter.

As shown in FIG. 5, the smaller the volume average particle diameter of the toner is, the larger the angle of repose is. In particular, when the volume average particle diameter is smaller than about 4.5 μm, the angle of repose rapidly increases to over 60°. From this result, it is known that, in the case where the small-diameter toner with the volume average particle diameter of 4.5 μm or less is used, the fluidity of the toner significantly decreases when compared to the case where the toner with a larger volume average particle diameter is used. Therefore, there is a particular concern that the clogging of the toner occurs.

THIRD EXPERIMENT

In the Third Experiment, the relationship between the volume average particle diameter of the toner and the fluidity of the toner is investigated by measuring the amount of projection (whose definition will be described later) of the toner.

Figure 6:
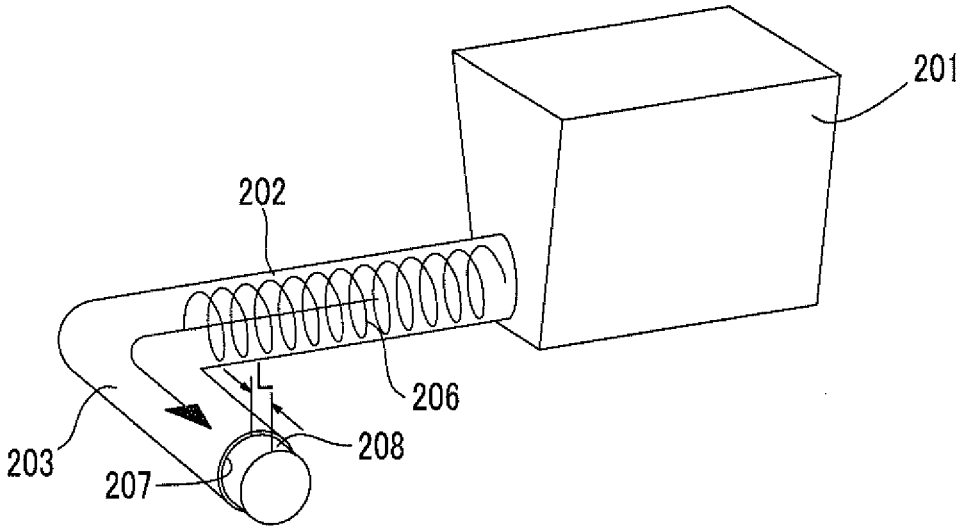
FIG. 6 is a schematic diagram showing an experiment for measuring the amount of projection of the toner.

FIG. 6 is a schematic diagram showing the experiment for measuring the amount of projection of the toner.

In the Third Experiment, toner in a container 201 is fed using a transport member 206 that is disposed inside a pipe 202, and is sent into a pipe 203 that is connected to the pipe 202 in such a manner as to form an L shape. No transport member is provided in the pipe 203. Also, the pipes 202 and 203 have positions above a floor surface. The toner sent into the pipe 203 is projected from an exit 207 thereof by toner that is pushed from behind.

In general, when the amount of projection is large, the portion that is projected collapses soon and drops onto the floor. However, in the Third Experiment, the amount of projection L of a projected portion 208 immediately before the collapse, at a moment when the measurement time elapses (refer to the followings for details), is measured with regard to the toner with the various volume average particle diameters [μm].

Measurement conditions in the Third Experiment are as follows.

Toner weight: 20 g
Measurement time: 1 min
Pipe inner diameter: 14 mm
Transport member: spring auger
Auger diameter: 13 mm
Auger pitch: 10 mm
Number of rotation: 50 rpm In general, the amount of projection L is small for the high-fluidity toner, and the amount of projection L is small for the low-fluidity toner. In the Third Experiment, it is possible to investigate the degree of the fluidity of the toner with the various volume average particle diameters [μm] by measuring the amount of projection L.

Figure 7:
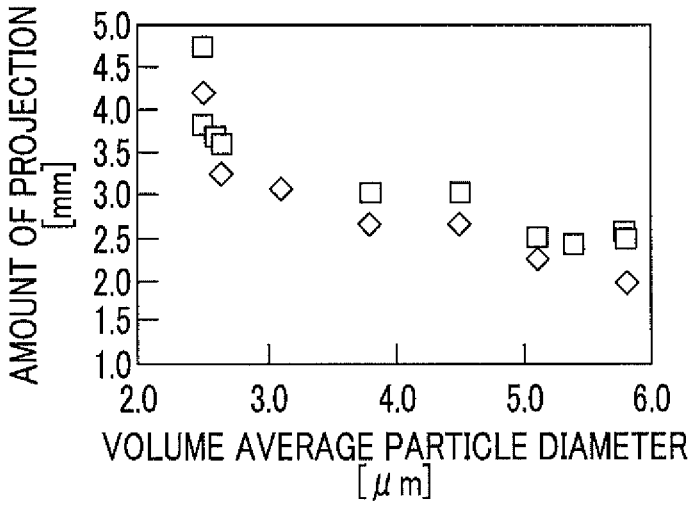
FIG. 7 is a view showing a result of measurement of the amount of projection [mm] with respect to the volume average particle diameter [μm] of the toner.

FIG. 7 is a view showing a result of the measurement of the amount of projection. L [mm] with respect to the volume average particle diameter [μm] of the toner. The difference in symbols in the same volume average particle diameter represents the toner of different types that have the same volume average particle diameter.

As shown in FIG. 7, the smaller volume average particle diameter of the toner has the larger amount of projection. In particular, when the volume average particle diameter is smaller than about 4.5 μm, the amount of projection rapidly increases to over 2.5 mm. From this result, it is known that, in the case where the small-diameter toner with the volume average particle diameter of 4.5 μm or less is used, the fluidity of the toner significantly decreases when compared to the case where the toner with a larger volume average particle diameter is used. Therefore, there is a particular concern that the clogging of the toner occurs.

Hereinabove, the three experiments showing the relationship between the volume average particle diameter and the fluidity of the toner have been described. Since it is difficult to make toner particles smaller than 2.0 μm, it is preferable to use the toner of at least 2.0 μm. Hereinafter, description will be continued returning to the exemplary embodiments of the present invention.

In the image forming apparatus 100 shown in FIG. 1, the development of the electrostatic latent image is performed by the small-diameter toner with the volume average particle diameter of 4.5 μm or less for image resolution improvement, and, in a toner transport mechanism shown in FIG. 2, measures are sought to inhibit the clogging of the toner. Hereinafter, the measures will be described.

As shown in FIG. 2, a front end portion 249 of the flat plate member 248, which is on a side away from the rotating shaft 242*b*, has a triangular shape that is separated from the rotating shaft 242*b* and is tapered with regard to a direction toward an inner wall 244*a* of a housing 244. As shown in FIG. 3, a pointed triangular edge (refer to FIG. 2) in the front end portion 249 of the rotating flat plate member 248 comes into contact with a toner wall 304 as shown by a dotted line in FIG. 3 soon after the toner wall 304 begins to be formed by the feeding of the toner to the transport member 243 by the flat plate member 248. The toner wall 304 cracks due to the contact with the front end portion 249, and balance is lost to cause the toner wall 304 to collapse. In this manner, the toner wall 304 cannot become too large in size, and the toner wall 304 is unlikely to be large enough in size to cause the above-described clogging of the toner. As a result, in the image forming apparatus 100 shown in FIG. 1, the clogging of the toner in the vicinity of the toner receiving port 247 is effectively inhibited even when the small-diameter toner is used.

Also, when the rotating shaft 242*b* rotates, the flat plate member 248 is separated from the inner wall 244*a* as shown in FIG. 2. If the rotating shaft 242*b* rotates and the flat plate member 248 comes into contact with the inner wall 244*a*, toner aggregate may be formed as the toner is pressed against the inner wall 244*a* by the rotation of the flat plate member 248, and the toner aggregate is used for image formation to cause a white dot-shaped image defect on the image. As shown in FIG. 2, according to the image forming apparatus 100 shown in FIG. 1, the flat plate member 248 is separated from the inner wall 244*a*, and thus the image defect problem caused by the toner aggregate is avoided.

Also, in the transport member 242, the entire flat plate member 248 including the triangular-shaped front end portion 249 is integrally molded with the round bar-shaped rotating shaft 242*b* of the transport member 242. Therefore, manufacturing costs are reduced when compared to a case where the triangular-shaped front end portion 249 is attached as a separate unit.

(Second Exemplary Embodiment)

Next, the second exemplary embodiment of the present invention will be described.

The difference between an image forming apparatus according to the second exemplary embodiment and the image forming apparatus 100 according to the first exemplary embodiment shown in FIG. 1 is that a front end portion of a flat plate member in the second exemplary embodiment is attached to a rest portion of the flat plate member as a separate unit from the rest portion. The second exemplary embodiment is the same as the first exemplary embodiment shown in FIGS. 1 to 3 with regard to the other points. Herein, redundant description will be omitted, and the description will be made focusing on the difference.

Figure 8:
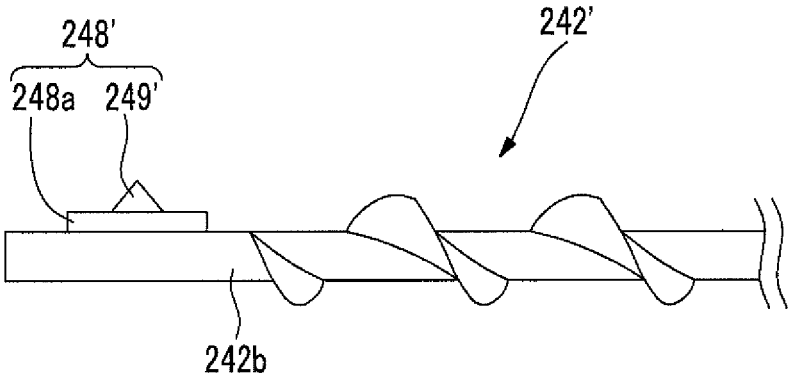
FIG. 8 is a view showing a flat plate member according to a second embodiment.

FIG. 8 is a view showing a flat plate member 248' according to the second exemplary embodiment.

The flat plate member 248' has a flat rectangular-shaped portion 248*a* that is integrally molded with the round bar-shaped rotating shaft 242*b* of a rectangular-shaped transport member 242', and a flat triangular-shaped front end portion 249' that is attached to a side of the rectangular-shaped portion 248*a*. The front end portion 249' is formed of a film-shaped flexible material. When a pointed triangular edge of the front end portion 249' is in contact with the toner wall, an elastic force caused by the bending of the front end portion 249' is added to the toner aggregate. Therefore, in the flat plate member 248', the toner wall is likely to be broken down, and the clogging of the toner is more effectively inhibited.

Next, a specific experiment in which the effect of preventing the clogging of the toner is verified will be described. In the experiment, the triangular-shaped front end portion is provided in the flat plate member to prevent the clogging of the toner.

In the experiment, the concentration (unit: %) of the toner in a central portion of the developing device is measured while continuously performing the output of the same image onto the sheet under constant temperature and humidity environments and supplying the toner with the volume average particle diameter of 4.5 μm to the developing device in the image forming apparatus of a first example, a first comparative example, and a second comparative example that will be described later. When the clogging of the toner occurs in the vicinity of the toner receiving port, the toner concentration in the central portion of the developing device decreases, due to the lack of the toner, to below target toner concentration that is a target value of the toner concentration which is necessary to output the above-described image under the above-described environments. In general, when the toner concentration decreases to be approximately 2.5% less than the target toner concentration, the clogging of the toner in the vicinity of the toner receiving port causes the transport member to be unable to rotate. In the experiment, the evaluation of the clogging of the toner (○ if the following situation does not occur, and X if the following situation occurs) is performed by finding out whether or not a situation in which the measured toner concentration decreases by 2.5% from the target toner concentration occurs until the output of 10,000 sheets.

The image forming apparatuses used in the experiment are the image forming apparatuses of the first example, the first comparative example, and the second comparative example that will be described hereinafter.

FIRST EXAMPLE

The image forming apparatus according to the first example has the same configuration as the image forming apparatus according to the first exemplary embodiment shown in FIG. 1, and uses a flat plate member which has a front end portion with the shape of an isosceles right triangle whose equal sides have a length of 5 mm as the flat plate member 248 shown in FIG. 2.

FIRST COMPARATIVE EXAMPLE

The image forming apparatus according to the first comparative example has the same configuration as the image forming apparatus according to the first example with the exception that the image forming apparatus according to the first comparative example has a flat plate member which has the shape of a rectangle in which a front end portion of the isosceles right triangle is removed from the flat plate member of the image forming apparatus according to the first example.

SECOND COMPARATIVE EXAMPLE

The image forming apparatus according to the second comparative example has the same configuration as the image forming apparatus according to the first example with the exception that the image forming apparatus according to the second comparative example does not include a flat plate member.

Table 1 below shows results of the above-described experiments using the image forming apparatuses according to the first example, the first comparative example, and the second comparative example.

TABLE 1

| | Triangular-shaped Front End Portion | Clogging of Toner |
|---|---|---|
| Example 1 | Yes | ○ |
| Comparative Example 1 | No (rectangular-shaped flat plate member is present) | X |
| Comparative Example 2 | No (rectangular-shaped flat plate member itself is not present) | X |

As shown in Table 1, the measured toner concentration decreases by 2.5% (evaluation is X) in the first comparative example and the second comparative example. However, in the first example, the measured toner concentration does not decrease by 2.5% (evaluation is ○).

As a result of the experiments, it is confirmed that, even when the flat plate member includes the triangular-shaped front end portion, the clogging of the toner may be effectively inhibited in the vicinity of the toner receiving port by using the small-diameter toner.

The exemplary embodiments of the present invention have been described hereinabove.

In the above description, a black-and-white single-sided output printer has been described as an example. However, the present invention may be applied to black-and-white double-sided output printers or double-sided color printers. Also, the present invention may be applied to copy machines and fax machines as well as printers.

In the toner transport device and the image forming apparatus, it is preferable to prepare points as follows.

The flat plate portion is integrally molded with the shaft member and is formed of a flexible material. The toner has a volume average particle diameter of 1.0 μm to 5.0 μm, preferably 2.0 μm to 4.5 μm and whose angle of repose may be at least 60°. In the toner transport device, the housing has a wall surface that extends along the shaft member on a side opposite to the end portion when viewed from the toner feeding member, and the flat plate portion is away from the wall surface during the rotation of the shaft member. In the image forming apparatus, the toner transport unit includes the toner transport device as in the aspect.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner transport device comprising:

a transport member that transports a developer in one direction;

a toner feeding member that is disposed adjacent to, in a direction crossing the one direction, an end portion of the transport member; and a housing that is provided with a toner receiving port which receives supply of toner in an upper section of the toner feeding member, and accommodates the transport member and the toner feeding member, wherein the toner feeding member includes:

a rotating shaft; and a flat plate portion that protrudes in a direction away from a shaft member with one side thereof being connected to the shaft member and a triangular-shaped front end portion which is away from the shaft member and having a tapered shape that forms the triangular-shaped front end portion, the flat plate portion rotating along with rotation of the shaft member to scrape the toner that moves from the toner receiving port toward the toner feeding member.

2. The toner transport device according to claim 1, wherein the flat plate portion is integrally molded with the shaft member.

3. The toner transport device according to claim 1, wherein the flat plate portion is formed of a flexible material.

4. The toner transport device according to claim 1, wherein the toner having volume average particle diameter of 1.0 μm to 5.0 μm is transported.

5. The toner transport device according to claim 1, wherein the toner having volume average particle diameter of 2.0 μm to 4.5 μm is transported.

6. The toner transport device according to claim 1, wherein the toner whose angle of repose is at least 60° is transported.

7. The toner transport device according to claim 1, wherein the housing has a wall surface that extends along the shaft member on a side opposite to the end portion when viewed from the toner feeding member, and the flat plate portion is away from the wall surface during the rotation of the shaft member.

8. The toner transport device according to claim 1, wherein the tapered shape is a pointed triangular edge in the triangular-shaped front end portion that comes into contact with a toner wall.

9. An image forming apparatus comprising:

an image forming unit that forms a toner image and fixes the toner image onto a recording medium; and a toner transport unit that is connected to the image forming unit to transport toner between the toner transport unit and the image forming unit, wherein the toner transport unit includes the toner transport device according to claim 1.

10. The image forming apparatus according to claim 9, wherein the toner has a volume average particle diameter of 1.0 μm to 5.0 μm.

11. The image forming apparatus according to claim 9, wherein the flat plate portion of the toner transport device is integrally molded with the shaft member.

12. The image forming apparatus according to claim 9, wherein the flat plate portion of the toner transport device is formed of a flexible material.

* * * * *